US009376285B2

(12) United States Patent
Wakabayashi

(10) Patent No.: US 9,376,285 B2
(45) Date of Patent: Jun. 28, 2016

(54) SHEET-STAPLING APPARATUS THAT STAPLES CENTER-FOLD SHEETS BY STAPLE, AND IMAGE-FORMING SYSTEM USING THE SAME

(71) Applicant: Konica Minolta, Inc., Chiyoda-ku, Tokyo (JP)

(72) Inventor: Hiroyuki Wakabayashi, Tokyo (JP)

(73) Assignee: KONICA MINOLTA, INC. (JP)

( * ) Notice: Subject to any disclaimer, the term of this patent is extended or adjusted under 35 U.S.C. 154(b) by 0 days.

(21) Appl. No.: 14/700,650

(22) Filed: Apr. 30, 2015

(65) Prior Publication Data

US 2015/0314980 A1 Nov. 5, 2015

(30) Foreign Application Priority Data

Apr. 30, 2014 (JP) ..... 2014-093651

(51) Int. Cl.

| | |
|---|---|
| ***G03G 15/00*** | (2006.01) |
| ***B65H 37/04*** | (2006.01) |
| ***B65H 37/06*** | (2006.01) |
| ***B42C 1/12*** | (2006.01) |

(52) U.S. Cl.

CPC *B65H 37/04* (2013.01); *B42C 1/12* (2013.01); *B65H 37/06* (2013.01); *G03G 15/6541* (2013.01); *B65H 2408/12* (2013.01)

(58) Field of Classification Search

CPC ..... G03G 2215/000827; G03G 2215/000831; G03G 15/6541; G03G 2215/00827; G03G 2215/00848; G03G 2215/00856; B65H 2301/453; B65H 2301/45; B65H 2301/4505; B65H 45/04; B65H 37/04; B65H 2408/12; B65H 37/06; B42C 1/12

See application file for complete search history.

(56) References Cited

U.S. PATENT DOCUMENTS

| | | | | |
|---|---|---|---|---|
| 2004/0048728 | A1* | 3/2004 | Trovinger | B65H 45/18 493/434 |
| 2007/0122255 | A1* | 5/2007 | Trovinger | B26F 1/24 412/33 |
| 2010/0239393 | A1* | 9/2010 | Suzuki | B42C 13/00 412/33 |
| 2010/0252983 | A1* | 10/2010 | Sugihara | B42B 4/00 270/58.08 |
| 2010/0258994 | A1* | 10/2010 | Kikkawa | B65H 45/18 270/37 |

FOREIGN PATENT DOCUMENTS

JP 2010150002 A 7/2010

* cited by examiner

*Primary Examiner* — Matthew G Marini
(74) *Attorney, Agent, or Firm* — Cantor Colburn LLP

(57) ABSTRACT

A sheet-stapling apparatus mounts a center-fold booklet and staples the booklet at a fold of the booklet by a staple. The sheet-stapling apparatus has a supporting member that mounts the center-fold booklet, pushing members that push the booklet to the supporting member, a stapler that penetrates the staple through the booklet and a clincher that clinches legs of the staple to bind the booklet. Each pushing member has a pushing recess portion for pushing the fold of the booklet. The pushing recess portion spreads from a booklet-positioning angle to a booklet-pushing angle to prevent the booklet from shifting.

6 Claims, 8 Drawing Sheets

RELATED ART

RELATED ART
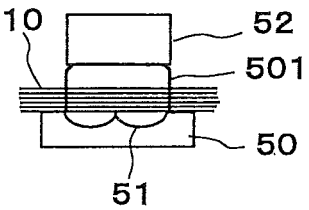
FIG. 2A
RELATED ART
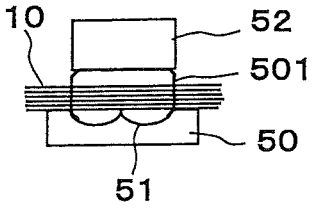
FIG. 2B
RELATED ART
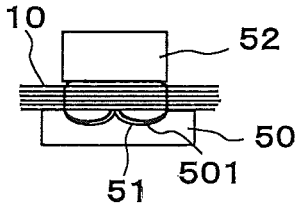
FIG. 2C
RELATED ART
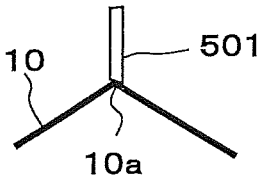
FIG. 3A
RELATED ART
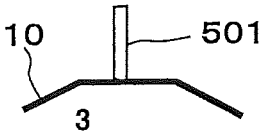
FIG. 3B
RELATED ART
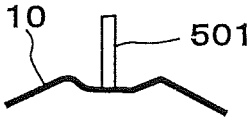
FIG. 3C
FIG. 4
RELATED ART
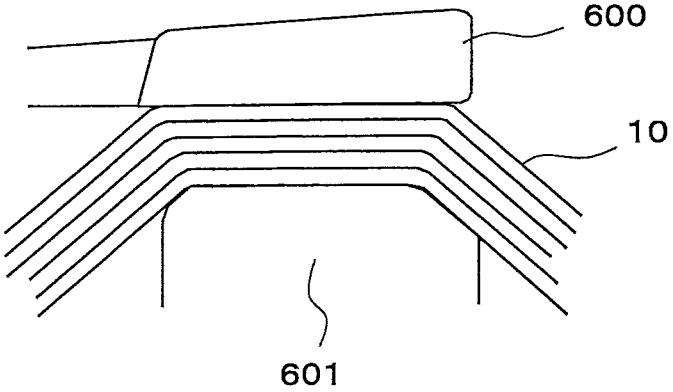

RELATED ART

SHEET-STAPLING APPARATUS THAT STAPLES CENTER-FOLD SHEETS BY STAPLE, AND IMAGE-FORMING SYSTEM USING THE SAME

CROSS REFERENCES TO RELATED APPLICATIONS

The present invention claims priority under 35 U.S.C. §119 to Japanese Application No. 2014-093651 filed Apr. 30, 2014, the entire content of which is incorporated herein by reference.

BACKGROUND OF THE INVENTION

1. Field of the Invention

The present invention relates to a sheet-stapling apparatus that staples center-fold booklet (sheets) by staple(s) and an image-forming system that uses such a sheet-stapling apparatus.

2. Description of Related Art

A technology to staple a bundle of sheets by a staple(s) has been known in the past. In order to allow the staple 501 to penetrate into a sheet 10P, it may have to shear apart of the sheet 10P by force for pushing the sheet 10P using the staple 501 as shown in FIG. 1A or to rupture a part of sheet 10P by force for pushing the sheet 10P using the staple 501 with fibers of the sheet 10P being extended as shown in FIG. 1B.

In both cases, the part of the sheet 10P sags by the staple 501 and when exceeding an allowable sagging amount thereof, the part of the sheet 10P opens. The staple 501 then penetrates into the opening of the sheet 10P. When increasing number of the sheets 10P, it is difficult for the staple 501 to penetrate into the sheets 10P because an apparent thickness of the sheets 10P is increased by the sag of the sheets 10P.

As shown in FIGS. 2A through 2C, the past clinch, namely, so-called spectacles type clinch in which legs of the staple are curled while the legs of the staple are still curved has performed to form a booklet. In this case, a clincher 50 mounts the booklet 10 in which plural sheets are bundled. Clincher 50 has a narrow cut 51 that allows the legs of the staple 501 to be curled.

A driver 52 drives the staple 501 to penetrate the legs of the staple 501 into the booklet 10 as shown in FIG. 2A. The driver 52 further drives the staple 501 to conduct the legs of the staple 501 penetrated into the booklet 10 to the narrow cut 51 of the clincher 50 as shown in FIG. 2B to bend them inwardly as shown in FIG. 2C.

A sheet-stapling apparatus that staples a center-fold booklet (sheets) by staple(s) has been proposed in the past as a sheet finisher for performing any staple processing on the sheets, and the like (see Japanese Patent Application Publication No. 2010-150002). It has been known that it is desirable to align a fold of each of the sheets with a position to be stapled by the staple with the prepared booklet being prevented from opening when the sheet-stapling apparatus forms the booklet by stapling the sheets using the staple(s).

Accordingly, a technology to perform any stapling processing on the center-folded booklet after the booklet is mounted has been known. As shown in FIG. 3A, when the driver drives the staple 501 to penetrate the legs of the staple 501 into the fold 10*a* of the center-folded booklet 10, an amount of work to be done by the staple 501 becomes larger than that done by the staple 501 in a case where the legs of the staple 501 penetrate into a flat part of the booklet 10 as shown in FIG. 3B because the staple 501 moves beyond the allowable sagging amount of the booklet 10. Accordingly, it is difficult for the staple 501 to penetrate into the booklet, so that any buckling of the staple may occur. Normally, as shown in FIG. 3C, by allowing the booklet 10 to sag, it may be easy for the staple 501 to penetrate into the booklet, which prevents the buckling of the staple from occurring.

By the way, as shown in FIG. 4, in order to clear up a difficulty for the staple to penetrate into the booklet, the staple processing has been performed in the past after a pushing member 600 has pushed the booklet 10 to a supporting member 601 to make flat a fold of the booklet to be stapled.

SUMMARY OF THE INVENTION

As described above, in the operation such that the legs of the staple penetrate into the fold of the center-fold booklet to staple the booklet, an amount of work to be done by the staple becomes larger because the legs of the staple penetrate into the booklet with the staple flattening each sheet.

In order to reduce the amount of work to be done by the staple, it is preferable that a pusher 600 having a flat pushing part for pushing the fold 10*a* of the booklet 10 pushes the booklet 10, as shown in FIG. 5A, to flatten the fold 10*a*. As shown in FIG. 5B, however, when the folds 10*a* of the sheets are flattened, force by the pusher 600 for holding the sheets becomes weak so that the booklet 10 may move to a direction that is perpendicular to the fold 10*a*. When the booklet 10 moves to this direction, the sheets may be out of their alignment of the folds 10*a* into which the legs of the staple penetrate.

On the other hand, when a pusher 602 having a recess portion with a triangular section which has an angle that is almost similar to an open angle of the booklet 10 pushes the booklet 10, as shown in FIG. 6A, the pusher 602 may apply to the booklet 10 any force that is sufficient to hold the sheets with the alignment of their folds 10*a*, as shown in FIG. 6B. This prevents the booklet 10 from moving to the direction that is perpendicular to the fold 10*a*. However, such a pusher 602 has less performance to flatten the fold 10*a* of the booklet 10. It, thus, is difficult to reduce an amount of work to be done by the staple when the legs of the staple penetrate into the booklet 10.

In addition, when a pusher 603 having a recess portion with a triangular section which has a larger angle than that of the pusher 602 pushes the booklet 10, as shown in FIG. 7A, such a pusher 603 is made more powerful to flatten the booklet 10 so that it is possible to reduce the amount of work to be done by the staple when the legs of the staple penetrate into the booklet 10. However, such a pusher 603 has less force to hold the sheets so that the booklet 10 may move when the pusher 603 starts pushing the booklet 10 as shown in FIG. 7B.

The present invention addresses the above-described issues by modifying the sheet-stapling apparatus that mounts a center-fold booklet (sheets) and staples the booklet at the fold of the booklet (each of the sheets) by a staple. The present invention provides a sheet-stapling apparatus in which prevention of the booklet from shifting and penetrability of the staple when stapling the booklet at the fold of the booklet are compatible with each other, and an image-forming system that uses such a sheet-stapling apparatus.

To achieve at least one of the above mentioned objects, a sheet-stapling apparatus reflecting one aspect of the present invention is a sheet-stapling apparatus that mounts a center-fold booklet and staples the booklet at a fold of the booklet by a staple. The sheet-stapling apparatus contains a stapler that penetrates the staple into the booklet, a clincher that clinches legs of the staple penetrated into the booklet, and a booklet-holding member that holds the mounted center-fold booklet before the stapler penetrates the staple into the booklet, wherein the booklet-holding member includes a pushing recess portion that is configured to be composed of at least two pushing surfaces and to have a triangular section, a vertex of the triangular section aligning the fold of the booklet, and the pushing recess portion is configured to change an angle of the vertex of the triangular section from a booklet-positioning angle to a booklet-pushing angle when the booklet-holding member pushes the mounted booklet.

According to embodiments of the present invention, it is desired to provide the sheet-stapling apparatus wherein the pushing recess portion is configured to set the booklet-positioning angle so as to be almost similar to a center-fold angle of the fold of the booklet and to set the booklet-pushing angle to be an angle that is larger than the booklet-positioning angle, holds a position of the fold of the booklet and flattens the fold of the booklet.

It is further desired to provide the sheet-stapling apparatus wherein the booklet-holding member includes a first pushing portion and a second pushing portion each having the pushing surface, each of the first and second pushing portions turning about a pivot to change the angle of the pushing recess portion, and the pivot is positioned so that the pivot opposes the fold of the booklet when the booklet-holding member pushes the mounted booklet.

It is additionally desired to provide the sheet-stapling apparatus wherein the booklet-holding member includes a supporting member that supports the booklet which is pushed by the pushing recess portion, the supporting member containing a flat supporting surface.

It is still further desired to provide the sheet-stapling apparatus wherein the supporting member further contains a supporting projection that is movable along a direction in which the booklet-holding member pushes the mounted booklet.

Other objects and attainments of the present invention will be become apparent to those skilled in the art upon a reading of the following detailed description when taken in conjunction with the drawing.

BRIEF DESCRIPTION OF THE DRAWINGS

FIG. 2A is a diagram showing a stapling example of a booklet by a staple;

FIG. 2B is a diagram showing the stapling example of the booklet by the staple;

FIG. 2C is a diagram showing the stapling example of the booklet by the staple;

FIG. 3A is a diagram showing a case of forming the booklet as a comparison example;

FIG. 3B is a diagram showing a case of forming the booklet as a comparison example;

FIG. 3C is a diagram showing a case of forming the booklet as a comparison example;

FIG. 4 is a schematic illustration that illustrates a configuration example of a past sheet-stapling apparatus;

DESCRIPTION OF THE PREFERRED EMBODIMENTS

The following will describe embodiments of a sheet-stapling apparatus and an image forming system using the same according to the present invention with reference to the drawings. Such description does not limit the technical scope, meaning of terms and the like in Claims.

<Configuration Examples of Sheet-Stapling Apparatus and Image-Forming System According to Embodiments of Present Invention>

Figure 1A:
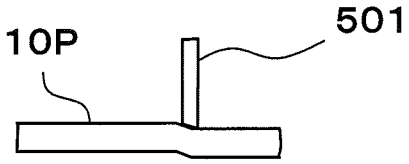
FIG. 1A is a diagram showing a penetration principle of staple.
Figure 1B:
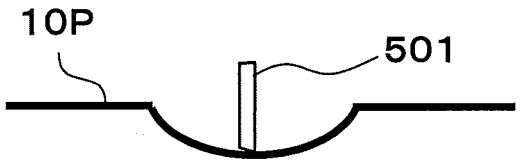
RELATED ART FIG. 1B
FIG. 1B is a diagram showing another penetration principle of staple.
Figure 5A:
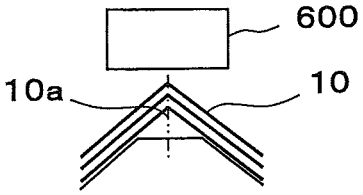
FIG. 5A RELATED ART
FIG. 5A is a diagram showing a method of the past sheet-stapling apparatus for stapling a booklet.
Figure 5B:
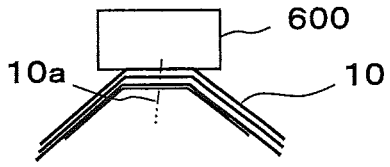
FIG. 5B RELATED ART
FIG. 5B is a diagram showing the method of the past sheet-stapling apparatus for stapling the booklet.
Figure 6A:
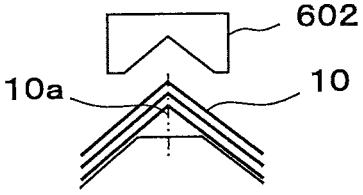
FIG. 6A RELATED ART
FIG. 6A is a diagram showing a method of another past sheet-stapling apparatus for stapling a booklet.
Figure 6B:
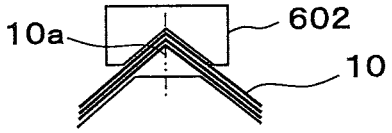
FIG. 6B RELATED ART
FIG. 6B is a diagram showing the method of this another past sheet-stapling apparatus for stapling the booklet.
Figure 7A:
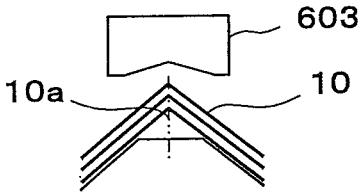
FIG. 7A RELATED ART
FIG. 7A is a diagram showing a method of other past sheet-stapling apparatus for stapling a booklet.
Figure 7B:
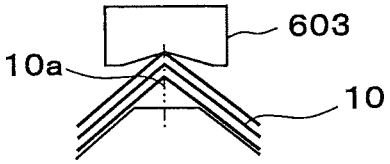
FIG. 7B is a diagram showing the method of this other past sheet-stapling apparatus for stapling the booklet.
Figure 8:
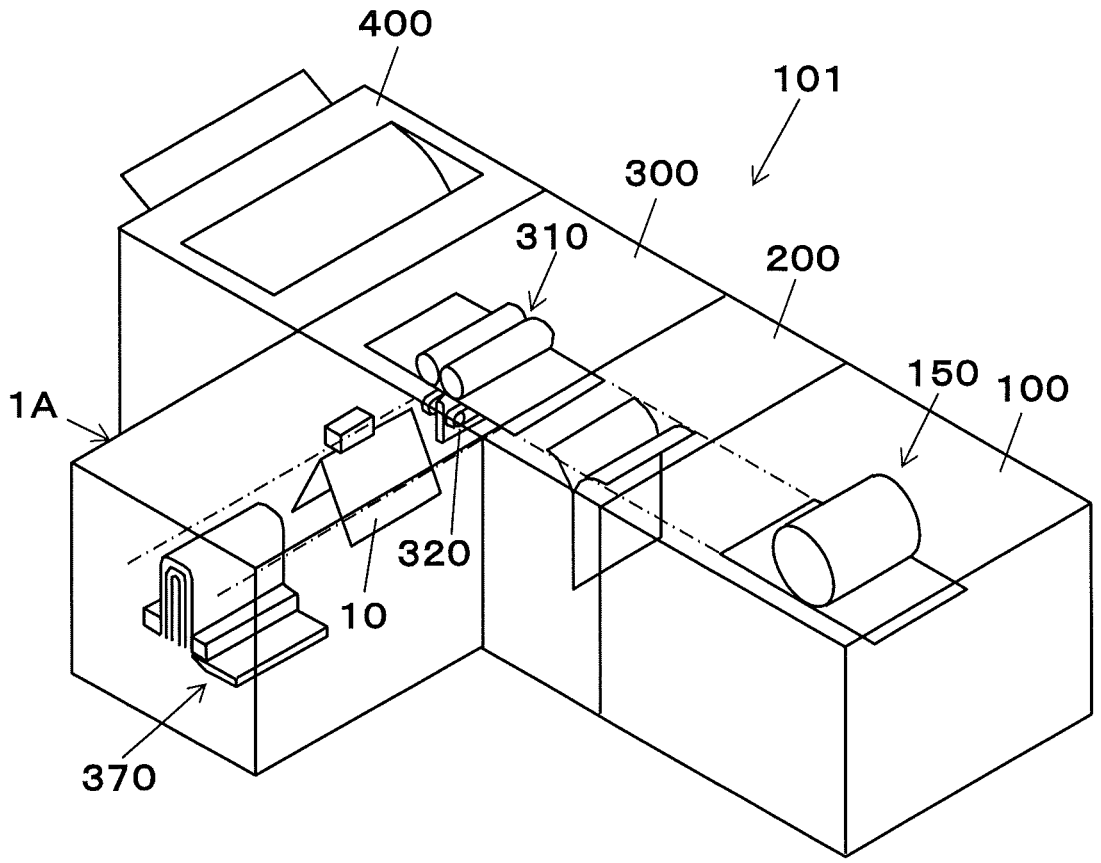
FIG. 8 is a perspective view of an image-forming system including a sheet-stapling apparatus according to an embodiment of the invention for showing a configuration example of the image-forming system.
Figure 9:
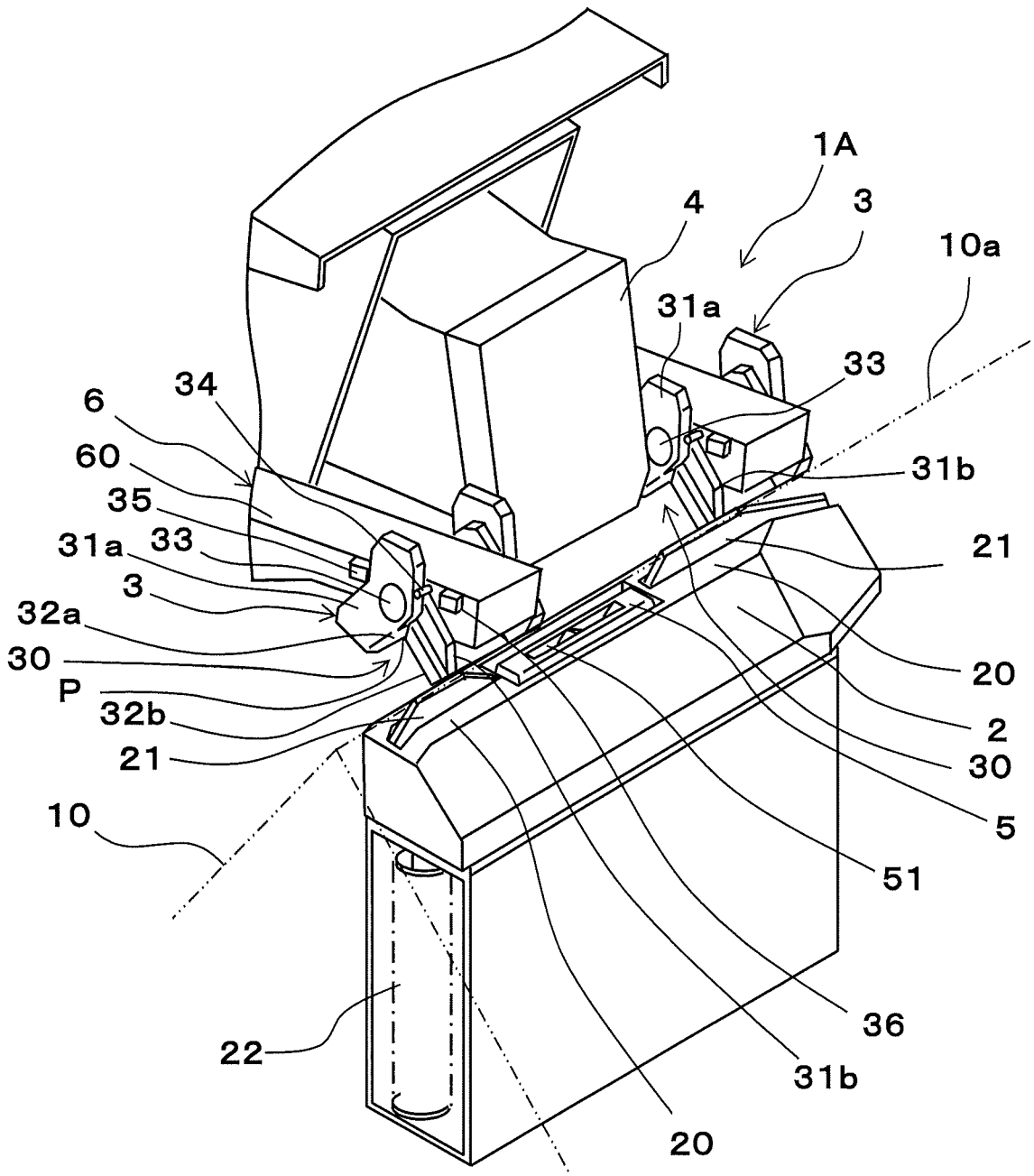
FIG. 9 is a perspective view of a sheet-stapling apparatus according to an embodiment of the invention for showing a configuration example of an important portion of the sheet-stapling apparatus.

An image-forming system 101, as shown in FIG. 8, according to an embodiment of this invention contains a sheet-stapling apparatus 1A according to an embodiment of this invention and an image-forming apparatus 100 that forms an image on a sheet and discharges it. The image-forming system 101 also contains an intermediate transportation apparatus 200, a saddle-stitching apparatus 300 and a side-stitching apparatus 400.

The image-forming apparatus 100 forms the image on the sheet. For example, the image-forming apparatus 100 contains a sheet-transporting portion that brings a sheet, which has been stored in a paper tray as recording medium, out of the paper tray to transport it. The image-forming apparatus 100 also contains a developing portion that develops a toner image based on bit map data on a primary transfer member such as a transfer roller, a primary transfer portion that transfers the toner image developed onto the primary transfer member to a secondary transfer member such as a transfer drum 150, a secondary transfer portion that transfers the toner image transferred to the secondary transfer member to a sheet transported by the sheet-transporting portion, a fixing portion that fixes the transferred toner image on the sheet and a discharging portion that discharges the sheet fixed by the fixing portion. The image-forming apparatus 100 transports the sheet on which the image has been formed to the intermediate transportation apparatus 200.

The intermediate transportation apparatus 200 temporarily holds the sheet and previously folds the sheet and/or trims the sheet. The intermediate transportation apparatus 200 contains a stacker that transports sheets fed from the image-forming apparatus 100 downward and stops the transportation of the sheets to stand for while they are held with their surfaces being almost faced to a vertical direction, an aligning portion that aligns positions of the held sheets, a creaser that forms a fold on the aligned sheets by folding them, and a slitter that trims any margin in each of the sheets while transporting the sheets on which the fold is formed.

The intermediate transportation apparatus 200 aligns the sheets transported from the image-forming apparatus 100 by the aligning portion while the stacker stops the transportation of the sheets, forms the fold by the creaser, and then, trims any margin in each of the sheets by the slitter while transporting the sheets on which the fold is formed. The intermediate transportation apparatus 200 then transports the sheets in which the margin has been trimmed by the slitter to the saddle-stitching apparatus 300.

The saddle-stitching apparatus 300 performs as a sheet-finisher a center-fold processing for center-folding the sheet (by two), a saddle-stitching processing to stack a predetermined numbers of center-fold sheets and bind them so that the saddle-stitched booklet is formed, an edge-cutting processing to cut the edge of the booklet and the like.

For example, the saddle-stitching apparatus 300 contains a center-folding portion 310 that center-folds each of the sheets transported from the intermediate transportation apparatus 200, a transporting mechanism 320 that transports each of the sheets center-fold by the center-folding portion 310 toward a direction extending along the fold of each of the sheets, a sheet-stapling apparatus 1A that staples the booklet 10 to form the saddle-stitched booklet after the sheets transported by the transporting mechanism 320 are stacked to form the booklet 10, and a cutting portion 370 that cuts the edge of the saddle-stitched booklet 10.

The following will describe the sheet-stapling apparatus 1A according to the embodiment of the invention more in detail with reference to FIGS. 9 through 12. In the sheet-stapling apparatus 1A according to this embodiment, the center-fold booklet 10 is mounted so as to be a convex upwardly. The sheet-stapling apparatus 1A contains a supporting member 2 on which the center-fold booklet 10 is mounted so as to be the convex upwardly and pushing members 3, 3 each pushing the booklet 10 to the supporting member 2. The sheet-stapling apparatus 1A also contains a stapler 4 that penetrates the staple into the booklet 10 and a clincher 5 that clinches the legs of the staple to bind the booklet 10. The clincher 5 has curved narrow cut 51, as show in FIGS. 2A through 2C, to form the past clinch, namely, so-called spectacles type clinch.

In the sheet-stapling apparatus 1A, the supporting member 2 is positioned around the clincher 5. The stapler 4 is positioned so as to face the clincher 5. The pushing members 3, 3 are positioned at both sides of the stapler 4 so as to face the supporting member 2.

The sheet-stapling apparatus 1A further contains a driving mechanism 6. The driving mechanism 6 drives the stapler 4 to approach the clincher 5 or move away from the clincher 5 and drives the pushing members 3, 3 to approach the supporting member 2 or move away from the supporting member 2 together with the stapler 4.

The supporting member 2 is an example of a booklet-holding member. The supporting member 2 contains supporting surfaces 20, 20 formed on both sides of the clincher 5 along a direction of the fold 10*a* of the booklet 10. The supporting surfaces 20, 20 are positioned at sides of the supporting member 2, which are opposite to the pushing members 3, 3, namely, those of an upper surface of the supporting member 2 in this embodiment. The supporting surface 20 supports the booklet 10 when it is pushed by the pushing members 3, 3. The supporting member 2 also contains supporting projections 21, 21 that support the fold 10*a* of the booklet 10.

Each of the supporting surfaces 20, 20 is configured to include a plane having a predetermined width along a direction that is perpendicular to the fold 10*a* of the booklet 10. The supporting projections 21, 21 are positioned ahead and behind the clincher 5 along the direction of the fold 10*a* of the booklet 10. The supporting projections 21, 21 are configured so as to be movable along a vertical direction in which the pushing members 3, 3 push the booklet 10. Springs 22 urge the supporting projections 21, 21 upwardly to project the supporting projections 21, 21 out of the supporting surface 20.

Each of the supporting projections 21, 21 has a shape corresponding to the fold 10*a* of the booklet 10, namely, a triangular shape in this embodiment. The supporting projections 21, 21 support the fold 10*a* of the booklet 10, which is mounted so as to be the convex upwardly to the lower portion thereof, from below. Supporting the fold 10*a* of the booklet 10 from below, namely, from an open side of the booklet 10 enables the fold 10*a* to be aligned to the stapler 4 by weight of the booklet 10 itself.

The pushing members 3, 3 are also the example of the booklet-holding member. Each of the pushing members 3, 3 includes a pushing recess portion 30 that pushes the fold 10*a* of the booklet 10. The pushing recess portion 30 is configured to have a triangular section that corresponds to a position of the fold 10*a* of the booklet 10 supported by the supporting projections 21, 21.

Each of the pushing members 3, 3 includes a first pushing portion 31*a* and a second pushing portion 31*b*. In this embodiment, the pushing recess portion 30 brings the first pushing portion 31*a* and the second pushing portion 31*b* to be intersected each other. The first pushing portion 31*a* and the second pushing portion 31*b* form an angle of the pushing recess portion 30 to hold the fold 10*a* of the booklet 10. The angle of the pushing recess portion 30 is configured to be an angle that is suitable for holding the fold 10*a* of the booklet 10 in each of the operations in which the pushing members 3, 3 push the booklet 10 and the staple penetrates into the booklet 10. The pushing recess portion 30 enables the angle thereof to be changed.

Each of the pushing members 3, 3 has a first pushing surface 32*a* on a lower surface, which is opposite to the supporting member 2, of the first pushing portion 31*a*. Each of the pushing members 3, 3 also has a second pushing surface 32*b* on a lower surface, which opposes the supporting member 2, of the second pushing portion 31*b*.

In each of the pushing members 3, 3, the first pushing portion 31*a* and the second pushing portion 31*b* are supported on an arm portion 60 constituting the driving mechanism 6 so that they can turn each other about a pivot 33. The pushing recess portion 30 is configured to be composed of a combination of the first pushing portion 31*a* and the second pushing portion 31*b* and have a triangular section at a vertex P thereof.

The pivots 33, 33 are positioned so as to be parallel with the fold 10*a* of the booklet 10 supported by the supporting projections 21, 21. The pivots 33, 33 are also positioned just above the fold 10*a* so that the pivots 33, 33 oppose the fold 10*a* of the booklet 10 when the pushing members 3, 3 push the booklet 10. In an operation such that the first pushing portion 31*a* and the second pushing portion 31*b* turn about the pivot 33, the vertex P of the triangular section in the pushing recess portion 30 does not shift from the position of the fold 10*a*.

Each of the pushing members 3, 3 contains a spring 34 that controls the angle of the pushing recess portion 30, which is an angle between the first pushing surface 32*a* and the second pushing surface 32*b*. The spring 34 is an example of urging member. For example, the spring 34 is composed of torsion coil spring.

The spring 34 applies to the pushing member 3 any force that allows the first pushing portion 31*a* and the second pushing portion 31*b* to turn about the pivot 33 so that the angle of the pushing recess portion 30 becomes smaller.

Each of the pushing members 3, 3 also contains stoppers 35, 36 which limit the angle of the pushing recess portion 30. The stoppers 35, 36 are examples of the angular limiter. Each of the stoppers 35, 36 is configured to be as projections from the arm portion 60. The first pushing portion 31*a* and the second pushing portion 31*b* respectively collide with the stoppers 35, 36 when the first pushing portion 31*a* and the second pushing portion 31*b* turn about the pivot 33.

In each of the pushing members 3, 3, the stopper 35 is provided at such a position that the first pushing portion 31*a* and the second pushing portion 31*b* respectively collide with it when they turn so that the angle of the pushing recess portion 30 becomes smaller. Further, in each of the pushing members 3, 3, the stopper 36 is provided at such a position that the first pushing portion 31*a* and the second pushing portion 31*b* respectively collide with it when they turn so that the angle of the pushing recess portion 30 becomes larger.

Figure 10:
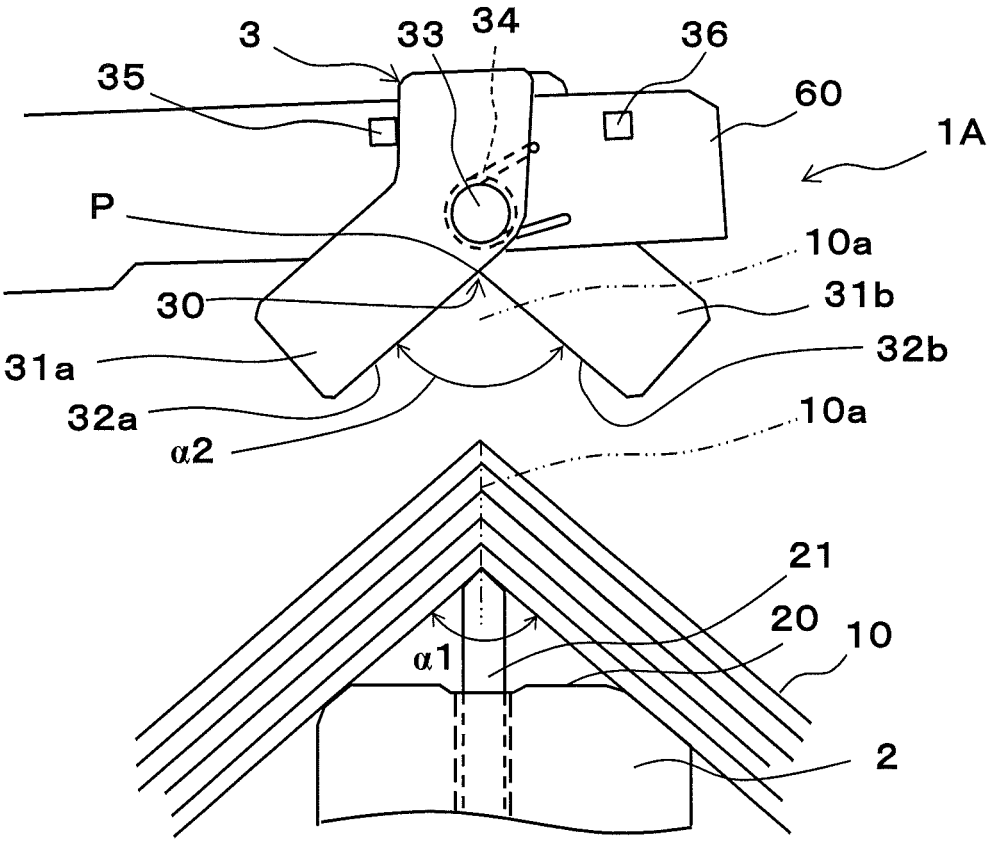
FIG. 10 is a side view of the sheet-stapling apparatus according to the embodiment of the invention for showing the configuration example of the important portion of the sheet-stapling apparatus.

At a timing of starting the pushing during the operation in which the pushing members 3, 3 push the booklet 10, the spring 34 urges the first pushing portion 31*a* and the second pushing portion 31*b* respectively to turn about the pivot 33 up to such a position that the first pushing portion 31*a* and the second pushing portion 31*b* collide with the stopper 35 (see FIG. 10).

In a state of each of the pushing members 3, 3 where the first pushing portion 31*a* and the second pushing portion 31*b* collide with the stopper 35, the angle of the pushing recess portion 30 is limited to a booklet-positioning angle $\alpha 2$ that is almost similar to a center-fold angle $\alpha 1$. The center-fold angle $\alpha 1$ is formed by the fold 10*a* of the booklet 10 mounted on the supporting member 2.

Figure 11:
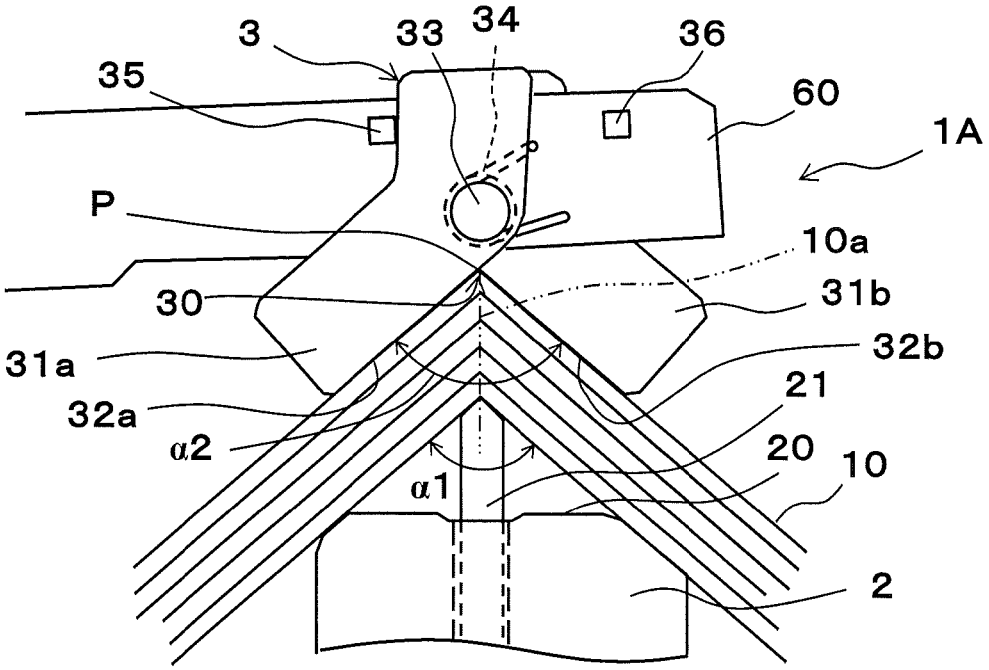
FIG. 11 is a side view of the sheet-stapling apparatus according to the embodiment of the invention for showing an operation example of the important portion of the sheet-stapling apparatus.

This angle of the pushing recess portion 30 enables the center-fold angle of the fold 10*a* to be held to the booklet-positioning angle $\alpha 2$, at the timing of starting the pushing during the operation in which the pushing members 3, 3 push the booklet 10 (see FIG. 11).

During the operation in which the pushing members 3, 3 push the booklet 10, the first pushing portion 31*a* and the second pushing portion 31*b* respectively turn so that the angle of the pushing recess portion 30 becomes larger.

Figure 12:
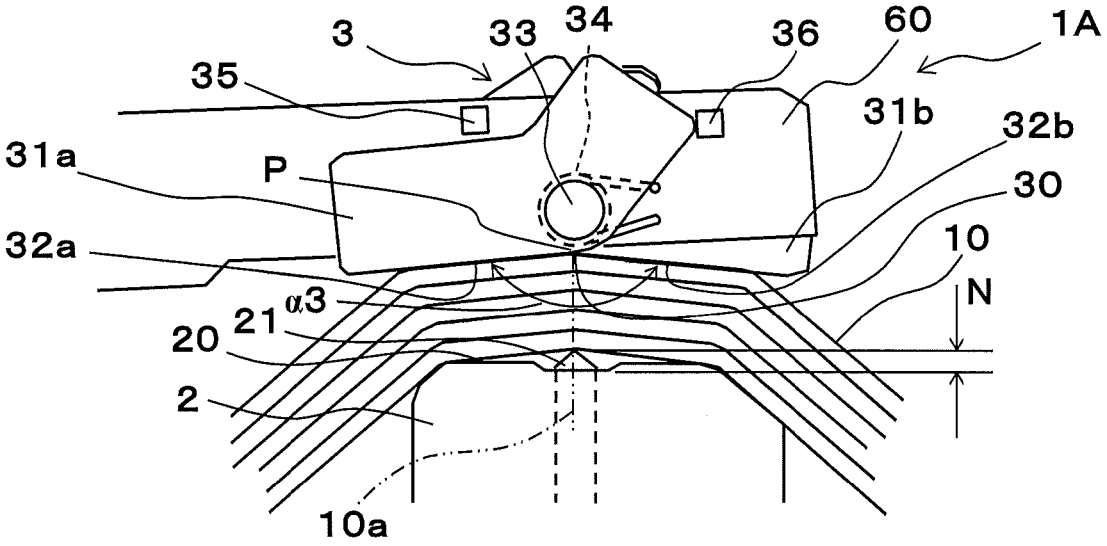
FIG. 12 is a side view of the sheet-stapling apparatus according to the embodiment of the invention for showing the operation example of the important portion of the sheet-stapling apparatus.

At a timing where the pushing members 3, 3 flatten the fold push 10*a* of the booklet 10, the first pushing portion 31*a* and the second pushing portion 31*b* of each of the pushing members 3, 3 respectively turn about the pivot 33 up to such a position that the first pushing portion 31*a* and the second pushing portion 31*b* collide with the stopper 36 (see FIG. 12).

In each of the pushing members 3, 3, when the first pushing portion 31*a* and the second pushing portion 31*b* respectively turn about the pivot 33 up to such a position that the first pushing portion 31*a* and the second pushing portion 31*b* collide with the stopper 36, the angle of the pushing recess portion 30 is limited to a booklet-pushing angle $\alpha$ 3 that is larger than the booklet-positioning angle $\alpha 2$.

This angle of pushing recess portion 30 enables the center-fold angle of the fold 10*a* to be held to the booklet-pushing angle $\alpha 3$, at a timing such that the pushing members 3, 3 flatten the booklet 10.

The booklet-positioning angle $\alpha 2$ is set to be a value such that a shape of the fold 10*a* can be kept at an angle which prevents the booklet 10 from moving to the direction that is perpendicular to the fold 10*a* at a starting operation of pushing the booklet 10 by the pushing members 3, 3.

Accordingly, even when the angle of the pushing recess portion 30 changes from the booklet-positioning angle $\alpha 2$ to the booklet-pushing angle $\alpha 3$ during the operation in which the pushing members 3, 3 push the booklet 10, the shape of the fold 10*a* is kept at the angle which prevents the booklet 10 from moving while the position of the fold 10*a* of the booklet 10 is held.

The booklet-pushing angle $\alpha 3$ is set to be a value such that a shape of the fold 10*a* can be kept at an angle which reduces a load that is applied to a staple at an operation in which the staple penetrates into the booklet 10.

In this embodiment, the center-fold angle $\alpha 1$ formed by the fold 10*a* of the booklet 10 mounted on the supporting member 2 is set to be about 90 degrees, the booklet-positioning angle $\alpha 2$ is set to be about 90 degrees through about 100 degrees and the booklet-pushing angle $\alpha 3$ is set to be about 140 degrees through about 160 degrees.

<Operation Examples of Sheet-Staple Apparatus and Image-Forming System According to these Embodiments>

Figure 13:
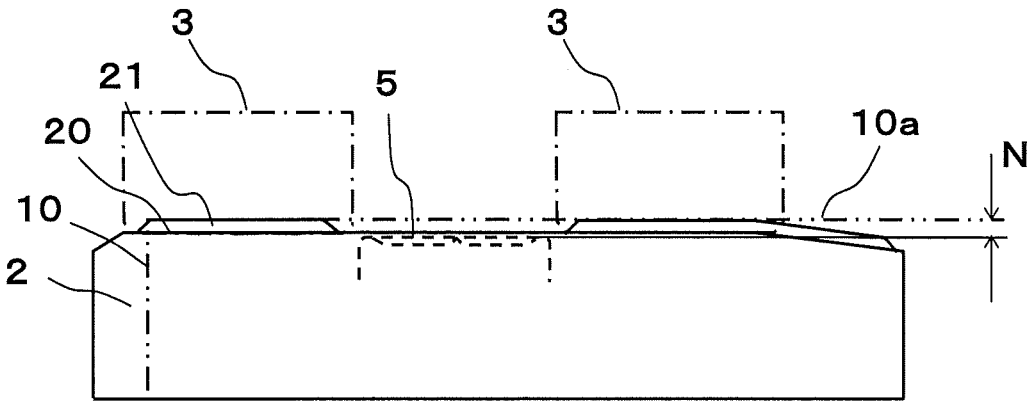
FIG. 13 is a diagram showing an operation example of the sheet-stapling apparatus according to the embodiment of the invention.

The following will describe operations to staple the booklet 10 in the sheet-stapling apparatus 1A with reference to the drawings. FIG. 13 shows an operation example of the sheet-stapling apparatus 1A according to the embodiment of the invention.

In the image-forming system 101, the saddle-stitching apparatus 300 performs a center-fold processing and a sheet-stack processing to form the booklet 10 and transports it to the sheet-stapling apparatus 1A in which the booklet 10 is mounted on the supporting member 2. The supporting projections 21, 21 then support the fold 10*a* of the booklet 10 mounted on the supporting member 2, as shown in FIG. 10.

In the sheet-stapling apparatus 1A, the driving mechanism 6 drives the pushing members 3, 3 to approach the supporting member 2. The pushing members 3, 3 then push the booklet 10 mounted on the supporting member 2. The pushing members 3, 3 and the supporting member 2 nip booklet 10.

In the operation in which the pushing members 3, 3 push the booklet 10, the first pushing portion 31*a* and the second pushing portion 31*b* respectively turn up to such a position that the first pushing portion 31*a* and the second pushing portion 31*b* collide with the stopper 35, as shown in FIG. 11, at a timing of starting the pushing. The angle of the pushing recess portion 30 enables the angle of the fold 10*a* to be held to the booklet-positioning angle $\alpha 2$.

If the pushing member having a plane pushing part pushes the fold 10*a* of the booklet 10, it flattens the fold 10*a* of the booklet 10. The fold 10*a* of the booklet 10 is flattened, so that force by the pushing member to hold the fold 10*a* becomes weak. This may move the booklet 10 to the direction that is perpendicular to the fold 10*a* of the booklet 10. When moving the booklet 10 to this direction, the fold 10*a* shifts from the position thereof in which the staple penetrates into the booklet 10.

In contrast, each of the pushing members 3, 3 of this invention holds the angle of the fold 10*a* to a predetermined booklet-positioning angle $\alpha 2$ at the timing of starting the pushing of the booklet 10. Since the fold 10*a* is folded with the booklet-positioning angle $\alpha 2$, the spring 34 applies force to a position near the fold 10*a* through the first pushing surface 32*a* and the second pushing surface 32*b*. Accordingly, any force that is sufficient for holding the fold 10*a* by the pushing members 3, 3 is applied to the booklet 10 so that it is possible to prevent the booklet 10 from moving to the direction that is perpendicular to the fold 10*a*. This prevents the fold 10 from shifting from the position in which the staple penetrates into the booklet 10.

The supporting member 2 has the flat supporting surfaces 20, 20 on both sides of the supporting projections 21, 21 along the direction that is perpendicular to the fold 10*a* of the booklet 10. The supporting projections 21, 21 are then pushed down against force by the springs 22 during the operation in which the pushing members 3, 3 push the booklet 10.

Thus, when the pushing members 3, 3 approach the supporting member 2 during the operation in which the pushing members 3, 3 push the booklet 10, the first pushing portion 31*a* and the second pushing portion 31*b* turn about the pivot 33 against the spring 34 so that the angle of the pushing recess portion 30 increases step by step from the booklet-positioning angle α2.

Since each of the pivots 33, 33 is positioned just above the fold 10*a* of the booklet 10 supported by the supporting projections 21, 21 with the pivots 33, 33 being parallel with the fold 10*a*, a vertex P of the triangular section of the pushing recess portion 30 does not shift from the position of the fold 10*a* even if the first pushing portion 31*a* and the second pushing portion 31*b* turn.

In addition, even when the angle of the pushing recess portion 30 increases step by step from the booklet-positioning angle α2 during the operation in which the pushing members 3, 3 push the booklet 10, the shape of the fold 10*a* is kept at the angle that prevents the booklet from moving.

Thus, even when the angle of the pushing recess portion 30 increases step by step from the booklet-positioning angle α2 during the operation in which the pushing members 3, 3 push the booklet 10, it is possible to prevent the fold 10*a* from shifting out of the position in which the staple penetrates into the booklet 10.

Further, in each of the pushing members 3, 3, the first pushing portion 31*a* and the second pushing portion 31*b* turn up to the position where they respectively collide with the stopper 36 at the timing such that the pushing members 3, 3 flatten the booklet 10 so that the angle of the pushing recess portion 30 becomes the booklet-pushing angle α3.

When the pushing members 3, 3 flatten the booklet 10 and each of the pushing members 3, 3 and the supporting member 2 nip the booklet 10, the fold 10*a* of the booklet 10 spreads out corresponding to the booklet-pushing angle α3. In this moment, as shown in FIG. 12, the supporting projections 21, 21 project from the supporting surface 20.

This enables a portion of the booklet 10 in which the fold 10*a* is formed to be not flatted. This also enables the center-fold angle α1 of the fold 10*a* to spread out corresponding to the booklet-pushing angle α3 of the pushing recess portion 30. Further, as shown in FIG. 13, the supporting projections 21, 21 support the fold 10*a* of the booklet 10 on both sides of the clincher 5 along the fold 10*a* of the booklet 10. Thus, a predetermined space N is formed between the fold 10*a* of the booklet 10 and the clincher 5 so as to correspond to the shape of the pushing recess portion 30 of each of the pushing members 3, 3.

In the booklet-holding state shown in FIG. 12, the driving mechanism 6 drives the stapler 4 to approach the clincher 5 together with the pushing members 3, 3. The stapler 4 and the clincher 5 then nip the booklet 10. The stapler 4 drives the staple to penetrate into the booklet 10. The clincher 5 clinches the legs of the staple penetrated into the booklet 10. This enables the booklet 10 to be stapled. The driving mechanism 6 drives the pushing members 3, 3 to move away from the supporting member 2 and drives the stapler 4 to move away from the clincher 5. This completes the staple processing.

Forming the space N between the fold 10*a* of the booklet 10 and the clincher 5 allows the booklet 10 to be flexible, as shown in FIG. 3C, when the staple penetrates into the booklet 10 in the operation of stapling the booklet 10 by the stapler 4. Thereby, it is easy for the staple to penetrate into the booklet 10. Accordingly, it is also possible to prevent any buckling of the staple from occurring. Although the pushed booklet 10 returns to its original shape after the pushing pressure by the pushing members 3, 3 has been released, the apparent thickness of the booklet is not increased in this embodiment. Accordingly, it is possible to prevent the forward ends of the legs of the staple from being lifted open.

Thus, since the fold 10*a* of the booklet 10 is not flatted and it is held so as to correspond to the booklet-pushing angle α3 of the pushing recess portion 30 in this embodiment, it is possible to flatten the booklet while the fold 10*a* of the booklet 10 remains. It is also possible to lower penetration force that is required when the staple penetrates into the booklet 10. Since the fold 10*a* of the booklet 10 is held so as to correspond to the booklet-pushing angle α3, it is possible to prevent the booklet 10 from shifting to the direction that is perpendicular to the fold 10*a* and to prevent the stapling position in which the staple penetrates into the booklet 10 from shifting from the fold 10*a*. This allows compatibility between the staple penetration performance for preventing any staple buckling and the stapling position accuracy.

When an operation to staple the booklet 10 by the stapler 4 is completed and the driving mechanism 6 drives the pushing members 3, 3 to move away from the supporting member 2, the spring 34 urges each pushing member 3 so that the first pushing portion 31*a* and the second pushing portion 31*b* turn about the pivot 33 so that the angle of the pushing recess portion 30 becomes smaller. The each pushing member 3 then returns to a position such that the first pushing portion 31*a* and the second pushing portion 31*b* collide with the stopper 35.

In the sheet-stapling apparatus 1A, the force that pushes the booklet 10 allows the angle of the pushing recess portion 30 to spread out from the booklet-positioning angle α2 to the booklet-pushing angle α3 during the operation such that the pushing members 3, 3 approaches the supporting member 2 to push the booklet 10 by using the spring 34 and the stoppers 35 and 36. The stopper 36 then limits the angles of the first pushing portion 31*a* and the second pushing portion 31*b* to prohibit the angle of the pushing recess portion 30 from spreading out over the booklet-pushing angle α3.

Further, during the operation such that the driving mechanism 6 drives the pushing members 3, 3 to move away from the supporting member 2, the spring 34 allows the angle of the pushing recess portion 30 to close from the booklet-pushing angle α3 to the booklet-positioning angle α2. Additionally, the stopper 35 limits the angles formed by the first pushing portion 31*a* and the second pushing portion 31*b* to prohibit the angle of the pushing recess portion 30 from closing below the booklet-positioning angle α2. Thus, such a simple configuration allows the angle of the pushing recess portion 30 to be controlled.

The pushing recess portion 30 is held at the booklet-positioning angle α2 at the timing of starting the pushing regardless of sizes, paper weight, numbers and species of the sheets constituting the booklet 10 and any sufficient load is applied thereto so that the booklet 10 cannot shift. At the timing of flattening the booklet 10, a load to be applied to the spring 34 is set so that the angle of the pushing recess portion 30 finishes spreading out up to the booklet-pushing angle $\alpha$3.

Further, at the timing of flattening the booklet 10, in order to stop moving the pushing members 3, 3 after the angle of the pushing recess portion 30 finishes spreading out up to the booklet-pushing angle $\alpha$3, such a control that a load applied to the pushing members 3, 3 or the like is detected and an amount of movement of the pushing members 3, 3 is limited is available in this invention.

This invention is applicable to the sheet-stapling apparatus that staples center-fold booklet by staple(s) and an image-forming system that uses such a sheet-stapling apparatus.

The terms and expressions which have been employed in the foregoing description are used therein as terms of description and not of limitation, and these are no intention, in the use of such terms and expressions, of excluding equivalent of the features shown and described or portions thereof, it being recognized that the scope of the invention is defined and limited only by the claims.

What is claimed is:

1. A sheet-stapling apparatus that mounts a center-fold booklet and staples the booklet at a fold of the booklet by a staple, the apparatus comprising:

a stapler that penetrates the staple into the booklet;

a clincher that clinches legs of the staple penetrated into the booklet; and a booklet-holding member that holds the mounted center-fold booklet before the stapler penetrates the staple into the booklet, wherein the booklet-holding member includes a pushing recess portion that is configured to be composed of at least two pushing surfaces and to have a triangular section, a vertex of the triangular section aligning the fold of the booklet, and the pushing recess portion is configured to change an angle of the vertex of the triangular section from a booklet-positioning angle to a booklet-pushing angle by an action of the booklet-holding member so that a fold of the mounted booklet spreads out while the booklet-holding member pushes the mounted booklet after the mounted booklet is positioned at the booklet-positioning angle.

2. The sheet-stapling apparatus according to claim 1 wherein the pushing recess portion is configured to set the booklet-positioning angle so as to be almost similar to a center-fold angle of the fold of the booklet and to set the booklet-pushing angle to be an angle that is larger than the booklet-positioning angle, holds a position of the fold of the booklet and flattens the fold of the booklet.

3. The sheet-stapling apparatus according to claim 1 wherein the booklet-holding member includes a first pushing portion and a second pushing portion each having the pushing surface, each of the first and second pushing portions turning about a pivot to change the angle of the pushing recess portion, and the pivot is positioned so that the pivot opposes the fold of the booklet when the booklet-holding member pushes the mounted booklet.

4. The sheet-stapling apparatus according to claim 1 wherein the booklet-holding member includes a supporting member that supports the booklet which is pushed by the pushing recess portion, the supporting member containing a flat supporting surface.

5. The sheet-stapling apparatus according to claim 4 wherein the supporting member further contains a supporting projection that is movable in relation to the supporting member along a direction in which the booklet-holding member pushes the mounted booklet.

6. An image-forming system comprising an image forming apparatus that form an image on a sheet and a sheet-stapling apparatus that mounts a center-fold booklet including the sheet and staples the booklet at a fold of the booklet by a staple, the sheet-stapling apparatus including:

a stapler that penetrates the staple into the booklet;

a clincher that clinches legs of the staple penetrated into the booklet; and a booklet-holding member that holds the mounted center-fold booklet before the stapler penetrates the staple into the booklet, wherein the booklet-holding member includes a pushing recess portion that is configured to be composed of at least two pushing surfaces and to have a triangular section, a vertex of the triangular section aligning the fold of the booklet, and the pushing recess portion is configured to change an angle of the vertex of the triangular section from a booklet-positioning angle to a booklet-pushing angle by an action of the booklet-holding member so that a fold of the mounted booklet spreads out while the booklet-holding member pushes the mounted booklet after the mounted booklet is positioned at the booklet-positioning angle.

* * * * *